US009764865B2

(12) United States Patent
Hanten et al.

(10) Patent No.: US 9,764,865 B2
(45) Date of Patent: Sep. 19, 2017

(54) ASSEMBLING APPARATUS, ASSEMBLING METHOD AND PACKAGING COMBINATION

(75) Inventors: Jürgen Hanten, Bad Nauheim (DE); Francesco Niedecker, Porza (CH)

(73) Assignee: Poly-clip System GmbH & Co. KG, Hattersheim (DE)

( * ) Notice: Subject to any disclaimer, the term of this patent is extended or adjusted under 35 U.S.C. 154(b) by 719 days.

(21) Appl. No.: 14/116,984

(22) PCT Filed: May 11, 2012

(86) PCT No.: PCT/EP2012/058794

§ 371 (c)(1),
(2), (4) Date: Jan. 27, 2014

(87) PCT Pub. No.: WO2012/152928

PCT Pub. Date: Nov. 15, 2012

(65) Prior Publication Data

US 2014/0150381 A1 Jun. 5, 2014

(30) Foreign Application Priority Data

May 11, 2011 (EP) ..... 11003881
Oct. 6, 2011 (EP) ..... 11008107

(51) Int. Cl.
*B65B 7/00* (2006.01)
*B65B 61/18* (2006.01)
(Continued)

(52) U.S. Cl.
CPC ..... *B65B 7/00* (2013.01); *B65B 61/186* (2013.01); *B65D 35/245* (2013.01); *B65D 35/38* (2013.01);
(Continued)

(58) Field of Classification Search
CPC B65B 7/00; B65B 7/14; B65B 61/186; B65B 7/28; B65B 7/2835; B65B 7/2871;
(Continued)

(56) References Cited

U.S. PATENT DOCUMENTS 4,707,966 A * 11/1987 Weiler ..... B29C 66/542 264/524
5,035,106 A * 7/1991 Haase ..... B65B 7/285 29/511
(Continued)

FOREIGN PATENT DOCUMENTS

DE 3831225 A1 3/1990
DE 29615877 U1 11/1996
(Continued)

OTHER PUBLICATIONS

Office Action issued in corresponding European Application No. 12719766.3-1708 dated Dec. 18, 2015 (6 pages).
(Continued)

*Primary Examiner* — Thanh Truong
*Assistant Examiner* — Dariush Seif
(74) *Attorney, Agent, or Firm* — Fitch, Even, Tabin & Flannery LLP

(57) ABSTRACT

The present invention relates to an apparatus and a method for assembling a packaging combination including a tubular casing having a first end and a second end, wherein the tubular casing is partially filled with filling material and closed at its first as well as its second end by a closure means, like a closure clip, and wherein the partially filled tubular casing comprises a plait-like portion at its first end being at least approximately free of filling material, and further including a dispensing device having a passageway extending through the dispensing device with an inlet opening at its one end and a dispensing opening at its other end
(Continued)

for guiding and dispensing the filling material in a dispensing direction. The present invention further relates to a packaging combination comprises a tubular casing, a dispensing device and a sealing device removably attached to the dispensing device.

17 Claims, 7 Drawing Sheets

(51) Int. Cl.
*B65D 35/24* (2006.01)
*B65D 35/38* (2006.01)
*B65D 51/18* (2006.01)

(52) U.S. Cl.
CPC ..... *B65D 51/18* (2013.01); *B65D 2251/0015* (2013.01); *B65D 2251/0093* (2013.01)

(58) Field of Classification Search
CPC ..... B65D 35/38; B65D 47/00; B65D 83/00; B65D 7/14
USPC ..... 53/410, 480, 484, 485, 486, 488, 281, 53/284, 284.7, 285, 287, 289, 329
See application file for complete search history.

(56) References Cited

U.S. PATENT DOCUMENTS

| | | | | |
|---|---|---|---|---|
| 5,429,273 | A | 7/1995 | King et al. | |
| 5,606,844 | A * | 3/1997 | Takagaki | B29C 65/08 53/133.2 |
| 5,944,073 | A * | 8/1999 | Klein | B65B 43/42 141/13 |
| 6,564,970 | B1 * | 5/2003 | Walch | B05C 17/00516 222/327 |
| 7,037,456 | B2 * | 5/2006 | Gruau | B29C 43/08 156/244.11 |
| 7,906,056 | B2 * | 3/2011 | Nishikawa | B29C 43/18 264/267 |
| 2003/0197022 | A1 | 10/2003 | Keller | |
| 2005/0198927 | A1 | 9/2005 | Summons et al. | |
| 2006/0157502 | A1 * | 7/2006 | Meausoone | B29C 45/164 222/92 |
| 2009/0236365 | A1 | 9/2009 | Summons et al. | |
| 2011/0131933 | A1 * | 6/2011 | Livingston | B67B 3/20 53/490 |

FOREIGN PATENT DOCUMENTS

| | | | |
|---|---|---|---|
| DE | 19964027 | A1 | 7/2001 |
| EP | 1854737 | A2 | 11/2007 |
| EP | 1988032 | A1 | 11/2008 |
| EP | 2157026 | A1 | 2/2010 |
| JP | 10-101155 | A | 4/1998 |
| WO | 8604041 | A1 | 7/1986 |
| WO | 2007091071 | A1 | 8/2007 |
| WO | 2007128996 | A1 | 11/2007 |

OTHER PUBLICATIONS

PCT/US2012/058794 International Search Report and Written Opinion dated Oct. 30, 2012, 19 pgs.

* cited by examiner

ASSEMBLING APPARATUS, ASSEMBLING METHOD AND PACKAGING COMBINATION

This application is a National Stage entry of International Application No. PCT/EP2012/058794, filed May 11, 2012 which claims priority to European Patent Application Nos. 11003881.7, filed May 11, 2011, and 11008107.2, filed Oct. 6, 2011, each of which were filed in the European Patent Office, all of which are hereby incorporated by reference.

BACKGROUND OF THE INVENTION

The present invention relates to an apparatus for assembling a packaging combination including a tubular casing and a dispensing device according to claim 1. The present invention further relates to a method for assembling said packaging combination according to independent claim 12. Moreover, the present invention relates to a packaging combination for accommodating and dispensing a viscous or granular filling material according to claim 16 as well as to a dispensing device according to claim 22 for being attached to a tubular casing and a partially filled tubular casing according to claim 23 to which a dispensing device may be attached.

From EP patent application 1 988 032, a tubular or sausage-shaped packaging is known, being filled with sausage meat. The sausage-shaped product is produced by closing a tubular casing at one end, filling the sausage meat into said tubular casing and closing the filled tubular casing at its respective other end. In order to allow an easier opening of the sausage-shaped product, perforation lines including a number of weak locations are provided on the casing, along which the casing may be opened by pulling off the casing material and dispensing the sausage meat.

Furthermore, packing combinations including a tubular casing packing and a dispensing device are known, e.g. from German laid open document 38 31 225, wherein a device for dispensing the filling material stored in a tubular or bag-shaped packing is disclosed. The device includes a rigid tube having a dispensing nozzle at its one end and being provided for containing completely a bag-shaped casing. The bag-shaped casing containing a pasty filling material, like an adhesive, has to be opened at one end and has then to be positioned in said rigid tube with its opened end facing the dispensing nozzle. A piston matching the inner diameter of the tube is thereafter pushed into the tube, thereby squeezing the bag-shaped packaging and dispensing the filling material through the dispensing nozzle.

With this known packaging combination, it is of disadvantage that the rigid tube has outer circumferential dimensions being such that the complete bag-shaped casing can be accommodated in said rigid tube. If this known packaging combination is provided as a disposable device, this solution is expensive due to the big rigid tube being made from relatively expensive plastics. If this known packaging combination used such that only bag-shaped casing is thrown away and the rigid tube is used several times, the bag-shaped casing must be opened outside the tube so that, when the opened bag-shaped casing is introduced in the rigid tube, filling material can accidently discharged and can pollute the environment.

The assembling of said known tubular casing and dispensing device to a packaging combination on one hand is cost and time expensive, since said assembling has to be made by hand. Moreover, in case that the dispensing device has to be reused, it has to be cleaned from the filling material, which comes into contact at least with the dispensing nozzle. On the other hand, in case that said packaging combination shall be used as a disposable packaging combination, a large amount of material, in particular the rigid tube is wasted, causing high costs.

Thus, it is an object of the present invention to provide an apparatus and a method with which a packaging combination can automatically and time and cost efficient may be assembled. Furthermore, it is an object of the present invention to provide a packaging combination producible on said assembling apparatus with which the above mentioned drawbacks have been overcome, and which allows an easy and safe opening of the tubular casing.

BRIEF SUMMARY OF THE INVENTION

According to the present invention, there is provided an apparatus for assembling a packaging combination which includes a tubular casing having a first end and a second end, wherein the tubular casing is partially filled with filling material and closed at its first as well as its second end by a closure means, like a closure clip, and wherein the partially filled tubular casing comprises a plait-like portion at its first end being at least approximately free of filling material. The packaging assembly further includes a dispensing device having a passageway extending through the dispensing device with an inlet opening at its one end and a dispensing opening at its other end for guiding and dispensing the filling material in a dispensing direction. The inventive apparatus comprises at least one supporting means for accommodating and retaining the at least partially filled tubular casing, including at least one cartridge for arranging the at least partially filled tubular casing in the assembling apparatus. The apparatus further includes at least one shaping means for creating a defined shape to the first end of the tubular casing, including at least one gripper means for gripping the first end of the at least partially filled tubular casing and at least one forming shoulder for forming a defined shape to the said first end and at least one mounting means for mounting the dispensing device to said first end of the tubular casing.

The at least partially filled tubular casing is preferably vertically arranged in the assembling apparatus by means of said cartridge. Naturally, in order to form a defined shape to the first end and to mount a dispensing device thereto, the at least partially filled tubular casing may also be provided in a horizontal alignment or in any other suitable angle.

With the inventive apparatus, a packaging combination including a tubular casing and a dispensing device may automatically be assembled without the need of manpower and manual work, whereby a large amount of time and costs may be saved.

In a preferred embodiment of the inventive assembling apparatus, the cartridge is coupled with a drive means for moving said cartridge, whereby the tubular casing may be accurately be positioned to be processed.

The drive means for the cartridge may be of any suitable kind, like an electrical or pneumatically drive. In advantageous configuration, the drive means include a piston/cylinder assembly.

In a further advantageous embodiment, the forming shoulder of the shaping means is a shaping ring having an inner surface corresponding to the shape to be created of the first end of the tubular casing. Said shaping ring facilitates an easy and reliable forming of a defined shape to said first end of the tubular casing. Thereby, said shaping ring may be provided as a single part, but also may be composed of a number of segments.

To ensure a save and reliable gripping of the first end of the tubular casing, the gripper means of the shaping means include at least one claw for gripping said first end of the tubular casing. By using said gripper claws, a gripping force may be adjusted, dependent on the kind of the packaging material, for avoiding damages of sad casing material or the closing means. In another embodiment, the gripper means can be formed by a suction device which sucks in the first and of the tubular casing. Moreover, any other device for providing a "gripping force" to "grip" and hold the first end of the tubular casing can be used.

For creating a defined shape to the first end of the tubular casing, advantageously, the shaping means and/or the gripper means include a drive means for reversible moving the shaping means and the gripper means relative to each other.

The assembling apparatus according to the present invention can comprise receiving means for receiving the partially filled tubular casing. By means of said receiving means which may be a conventionally conveyor, the apparatus may be coupled to a clipping machine in which said tubular casing can be produced. In this case, it is possible to control the assembling apparatus on the basis of a signal from said clipping machine.

For automatically and defined providing the dispensing device to be mounted to the tubular casing, the apparatus comprises receiving means for receiving the dispensing device.

In order to prevent the filling material in the packaging combination from being contaminated or escaped, a closure cap may be attached to said packaging combination. Additionally or alternatively, for an easy and accurate dispensing of the filling material, also a dispensing nozzle may be provided. Accordingly, in an advantageous configuration, the assembling apparatus comprises attachment means for attaching a closure cap and or a dispensing nozzle to the dispensing device.

In a preferred embodiment of the inventive apparatus, at least the supporting means, the shaping means and the mounting means are arranged in work stations to enable an efficient assembling of the tubular casing and the dispending device.

Moreover, there is provided a method for assembling a packaging combination including a tubular casing having a first end and a second end, wherein the tubular casing is partially filled with filling material and closed at its first as well as its second end by a closure means, like a closure clip, and wherein the partially filled tubular casing comprises a plait-like portion at its first end being at least approximately free of filling material. The packaging combination further includes a dispensing device having a passageway extending through the dispensing device with an inlet opening at its one end and a dispensing opening at its other end for guiding and dispensing the filling material in a dispensing direction. The method comprises the steps of accommodating and retaining the at least partially filled tubular casing, positioning a forming shoulder at the first end of the tubular casing, gripping the first end of the tubular casing, forming a defined shape to the first end of said tubular casing by moving the tubular casing and the forming shoulder relative to each other, and mounting a dispensing device to said first end of said tubular casing.

According to the present invention, the method further comprises, not necessarily in this order, the steps of receiving the at least partially filled tubular casing, moving the at least partially filled tubular casing between working stations including at least the supporting means, the shaping means and the mounting means, and attaching a closure cap and a dispensing nozzle to the dispensing device.

The inventive method thereby provides the same advantages as disclosed in conjunction with the inventive assembling apparatus. With the inventive assembly apparatus as well as method, it is possible to assemble packaging combination with a dispensing device the axial length of which is substantially shorter than the axial length of the tubular casing. Thus, if such a packaging combination shall be used as a disposable packaging combination, the burden of the environment due to a bulky dispensing device, like in the prior art, is reduced.

Moreover, in accordance with the present invention, there is provided a packaging combination for accommodating and dispensing a viscous or granular filling material, the packaging combination comprises a tubular casing having a first end and a second end, wherein the tubular casing is partially filled with filling material and closed at its second end by a closure means, like a closure clip, wherein the first end is at least approximately free of filling material. The packaging combination further comprises a dispensing device having a passageway extending through the dispensing device with an inlet opening at its one end and a dispensing opening at its other end for guiding and dispensing the filling material in a dispensing direction. The dispensing device is attached to the first end of the partially filled tubular casing, wherein the first end extends inside the passageway of the dispensing device. At least a sealing element is removably attached to the dispensing device for closing and sealing the dispensing opening of the dispensing device.

This configuration of a packaging combination enables a safe and easy opening of the tubular casing by removing the sealing element from the dispensing opening and dispensing the filling material just by squeezing the filled tubular casing portion. Thus, an accidental discharge of filling material, while introducing the casing into a dispensing tube is prevented. Furthermore, the sealing device removably attached to the dispensing device, allows an indication of the original closure of the packaging combination and an easy and clean opening of said packaging combination without the need of any opening tools.

In an advantageous embodiment of the packaging combination according to the present invention, the dispensing device includes at least a first and a second portion, wherein the first portion extends from the inlet opening of the passageway in the dispensing direction and the second portion extends from the dispensing opening opposite to the dispensing direction, and wherein the inner circumferential dimensions of the first portion corresponds at least approximately to the outer circumferential dimensions of the tubular casing.

That means that the cross-section of the first portion of the dispensing device corresponds to the cross-section of the tubular casing, i.e. both, the first portion and the tubular casing, are of a circular cross-section, whereby the outer diameter of the tubular casing corresponds to the inner diameter of the first portion of the dispensing device. This allows a form-fit attachment of the dispensing device to the filled tubular casing. The term "circumferential dimension" has not only to be understood as the sole circumference, but also as a dimension characterizing a cross-section, like the length or width of a rectangle, a side length of a triangle or a diameter of a circle. Naturally, the first portion of the dispensing device and the tubular casing may be of any other suitable form, i.e. of a rectangular or triangular shape, the remarkable point is that their cross sections or circumferential dimensions correspond to each other.

According to the present invention, the packing combination includes a closure cap reversibly attachable to the dispensing device for releasing and closing the dispensing opening. A reversibly attachable closure cap reliably prevents the filling material from unintentionally escaping from the packaging combination and further allows storing and reusing an opened packaging.

In a preferred constitution, an indicating unit for indicating the originality of the closure of the dispensing opening provided at the dispensing device. Alternatively, the indicating unit may be attached to the closure cap. Said indicating unit surely displays whether or not the inventive packaging combination has already been opened.

As mentioned above, the dispensing device is attached to the tubular casing for forming the inventive packaging combination. To avoid the dispensing device from dropping off from the tubular casing, the dispensing device is secured to the first end of the tubular casing by an adhesive, in particular, by a hot-melt adhesive. Naturally, in case that sensitive filling materials are filled into the tubular casing, other adhesive means, like an adhesive tape, may be used, which e.g. may not be heated.

The object of the present invention may also be solved by a dispensing device for being attached to a tubular casing to form a packaging combination according to the invention described above.

In case that the dispensing device is provided as a disposable the amount material which has to be thrown away is remarkably reduced compared to the material in the case of known packaging combinations as described previously. This will reduce costs for producing the packaging combination and will also protect the environment.

Moreover, the object of the present invention may further be reached by a tubular casing partially filled with a filling material and closed at its first as well as its second end by a closure means, like a closure clip, for being combined with a dispensing device to from a packing combination according to the invention de-scribed above.

Further advantages and a preferred embodiment will be described in the following together with the drawings listed below. The expressions "left", "right", "below" and "above" are referred to the drawings in an alignment such that the reference numbers used can be read in normal.

DETAILED DESCRIPTION

Figure 1:
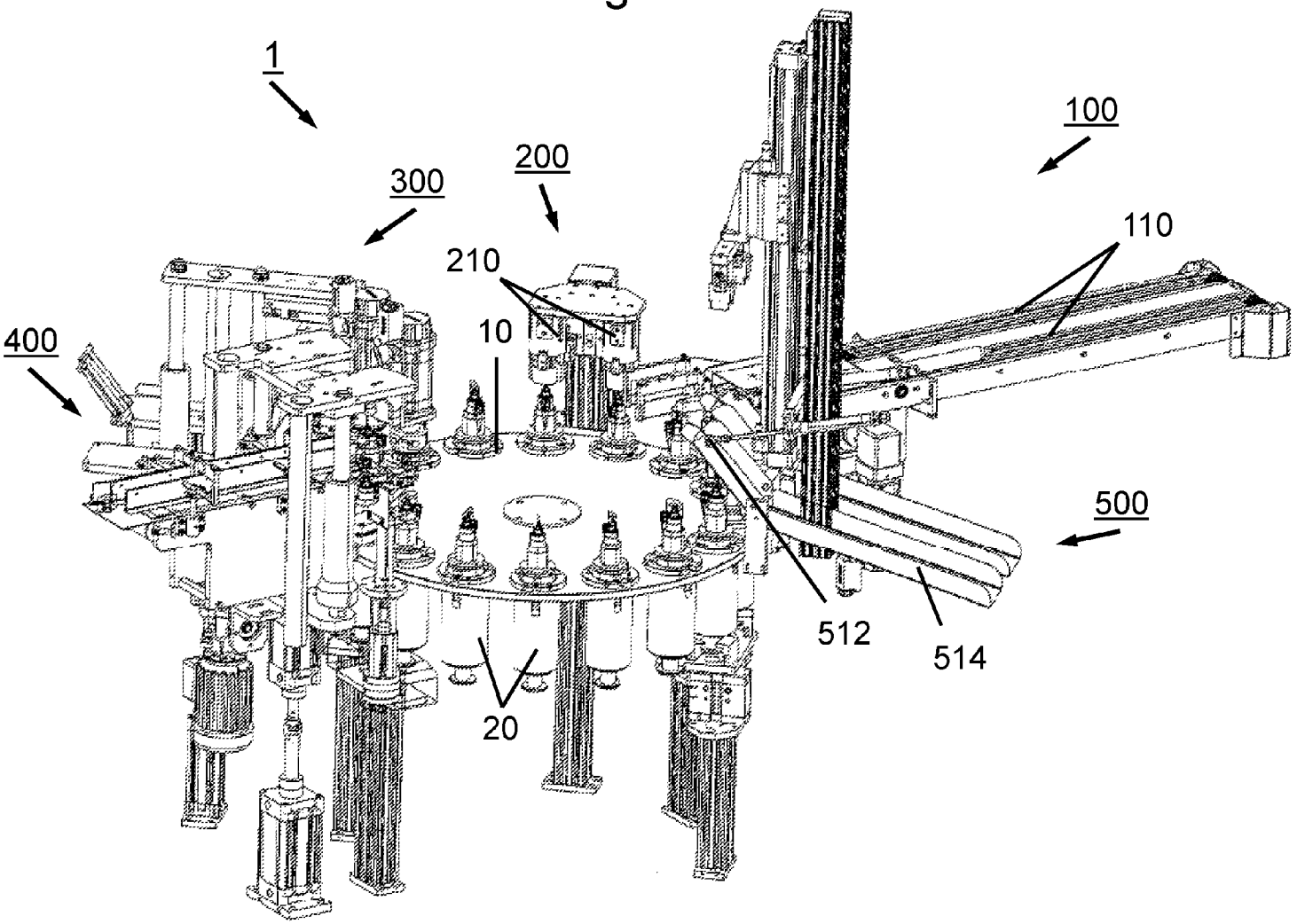
FIG. 1: is a schematically perspective view to an assembling apparatus according to the present invention.

FIG. 1 shows a schematically perspective view to an assembling apparatus 1 according to the present invention. The assembling apparatus 1 comprises a circular table 10, which holds supporting means 20 for accommodating and retaining a number of at least partially filled tubular casings while a dispensing device is mounted to each of said tubular casings. The apparatus further comprises a number of work stations 100, 200, 300, 400, 500, which are arranged around table 10 for processing tubular casings 30, when positioned in their working area.

Circular table 10 is horizontally arranged and supported to be rotatable about its vertically arranged central axis by a respective drive (not shown). Concentrically to and along the outer edge of table 10 and at equal distances to each other, the supporting means in form of cartridges 20 are vertically arranged. As it can be seen from FIG. 2, each cartridge 20 includes a barrel 22 which has an inner diameter corresponding to the outer diameter of a filled tubular casing 610, and in which said tubular casing 610 is form-fit accommodated. For transporting tubular casing 610 to the respective work station, table 10 is rotated counter-clockwise.

Work station 100 includes the receiving means for receiving a tubular casing 610. According to FIG. 1, said receiving means is formed by two parallel and horizon-tally arranged band conveyors 110 which both can deliver two tubular casings 610 to table 10 at the same time. It has to be understood, that in this case two cartridges 20 are positioned in working or receiving station 100 for receiving the tubular casings 30 just delivered.

In the next working station 200, counter-clockwise arranged beside receiving station 100 at table 10, the shaping means 210 are positioned at least approximately above cartridges 20 when positioned in working or shaping station 200. Shaping station 200 includes two identical shaping means 210 for simultaneously creating a defined shape to the first ends of tubular casings 610.

Following shaping station 200 in counter-clockwise direction, a mounting station 300 is positioned at circular table 10, for mounting dispensing device 620 to tubular casing 610 for forming a packaging combination 600. Even if not shown in detail, mounting station 300 includes feeding means for feeding dispensing device 620 to mounting station 300. Dispensing device 620, when delivered to mounting station 300, is already provided with an appropriate portion of adhesive G at one of its inner surfaces to be secured to tubular casing 610. In an alternative embodiment, mounting station 300 may include a dispensing apparatus for dispensing an adhesive to dispensing device 620 immediately before mounting dispensing device 620 to tubular casing 610. In case that the adhesive is a hot-melt adhesive, mounting station 300 includes a respective heating device known in the art.

Figure 6:
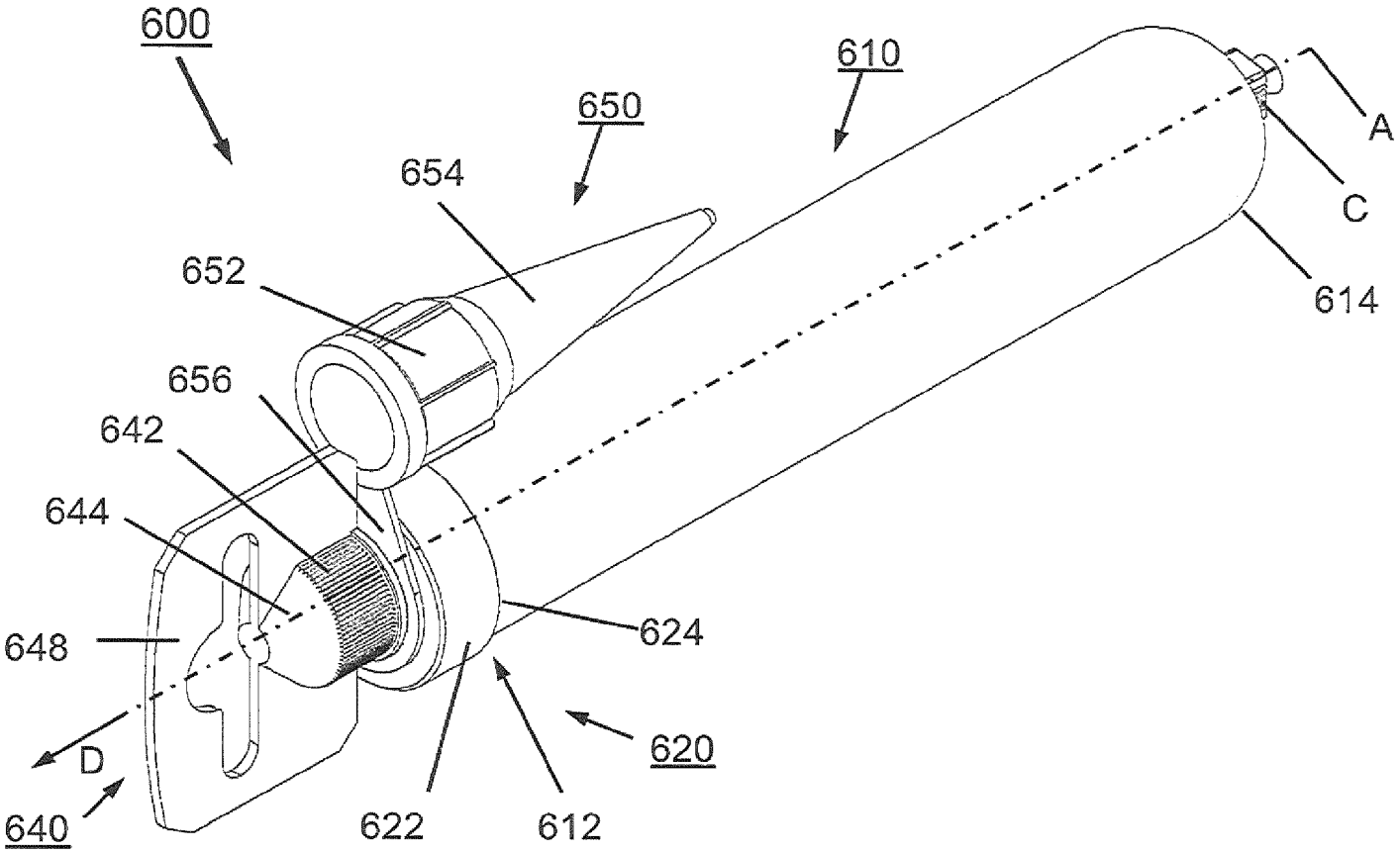
FIG. 6: is a perspective view to a second embodiment of the packaging combination according to the present invention.

Assembling apparatus 1 according to the embodiment of FIG. 1 further includes an attachment station 400 for attaching a closure cap 640 and or a dispensing nozzle 650 to dispensing device 620 (see FIG. 6). In particular, the closure cap 640 for closing the dispensing opening of dispensing device 620, in a preferred embodiment, includes an inner screw thread for being screwed to dispensing device 620, which has a respective outer screw thread. Together with the closure cap, the dispensing nozzle may be attached to dispensing device 620, e.g. by means of a latch which is secured to dispensing device 620 by the closure cap when screwed to dispensing device 620.

Further in a counter-clockwise direction, a discharge station 500 as a last work station is arranged at circular table 10. Discharge station 500 includes discharge means 510 in the form of a lifter arrangement 512 for lifting the packaging combination 600 consisting of tubular casing 610 and dispensing device 620 from cartridges 20, and a conveyor arrangement 514 including a chute for distributing the packaging combination from assembling apparatus 1 for further treatment.

Assembling apparatus 1 further includes a sealing station (not shown in FIG. 1). Said sealing station is arranged at table 10 between mounting station 300 for mounting dispensing device 620 to tubular casing 610 and attachment station 400 for attaching a closure cap 640 and/or a dispensing nozzle 650 to dispensing device 620. The sealing station includes removing means for removing the closure clip C temporarily attached to plait-like portion P at first end 612 of tubular casing 610, and sealing means for sealing device 630 to a dispensing opening 628 of dispensing device 620. The removing means may be realized by respective gripping means for gripping the closing clip C at plait-like portion P and one or more cutting elements for cutting off said closure clip C from plait-like portion P.

Figure 2:
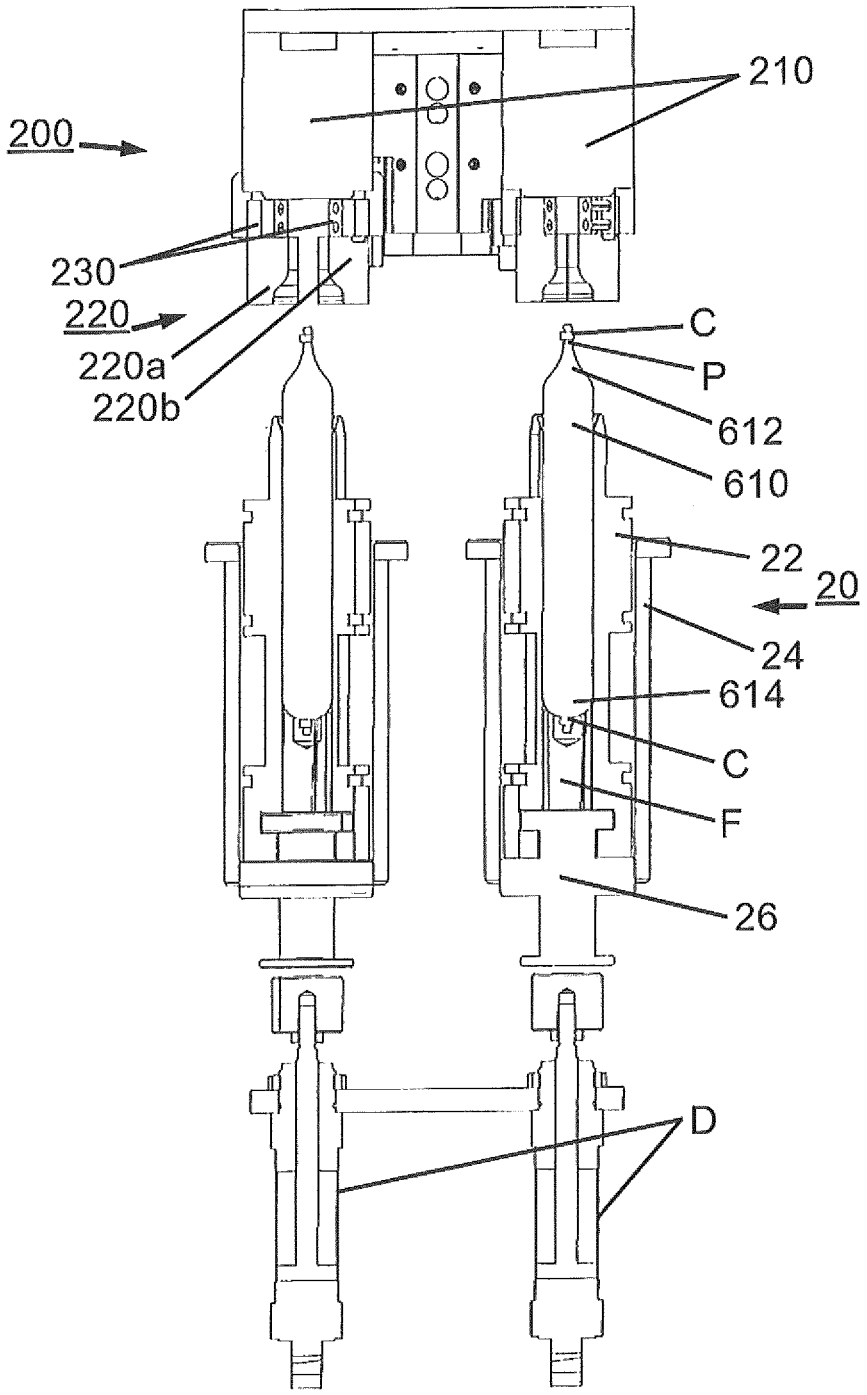
FIG. 2: is a schematically cross-section of the shaping station of the assembling apparatus according to FIG. 1.

FIG. 2 is a schematically cross-section of shaping station 200 of assembling apparatus 1 according to FIG. 1. Shaping station 200 includes two identical shaping means 210 each including a shaping ring 220, gripper claws 230 and drives (not shown) for actuating and moving shaping ring 220 and claws 230 as de-scribed in detail below. As it can be seen in FIG. 2, shaping ring 220 consists of two semicircular segments 220*a*, 220*b*. Alternatively, shaping ring 220 may also be formed as one element or may include more than two segments.

In shaping station according to FIG. 2, two cartridges 20 are positioned vertically below shaping means 210 and held by table 10 (not shown in FIG. 2). Each cartridge 20 includes an approximately cylindrical barrel 22, which is mounted to a cylinder 24 and vertically movable therein. A piston 26 is attached to the bottom section of barrel 22 and extends through the bottom of cylinder 24.

Below cartridge 20, a drive assembly Z including two identical drive elements in the form of a piston/cylinder combination is arranged to act on piston 26 in order to move barrel 22 together with tubular casing 610 upwardly, whereby the upper or first end 612 of tubular casing 610, including plait-like portion P, which is closed by closure clip C, is positioned in the working area of shaping means 210. Tubular casing 610 is positioned in barrel 22 with its lower or second end 614, which is also closed by a further closure clip C, directed downwardly. Between the bottom of barrel 22 and the second end 614 of tubular casing 610, a fitting element F is positioned, for adapting cartridge 20 to the length of tubular casing 610 which has to project from the upper edge of barrel 22 about a predetermined length. For handling e.g. a longer tubular casing than that shown in FIG. 2, a respectively shorter fitting element F is to be placed in barrel 22. In adaption to a different diameter of tubular casing 610, barrel 22 may be exchanged to one of a respectively other inner diameter.

Figure 3:
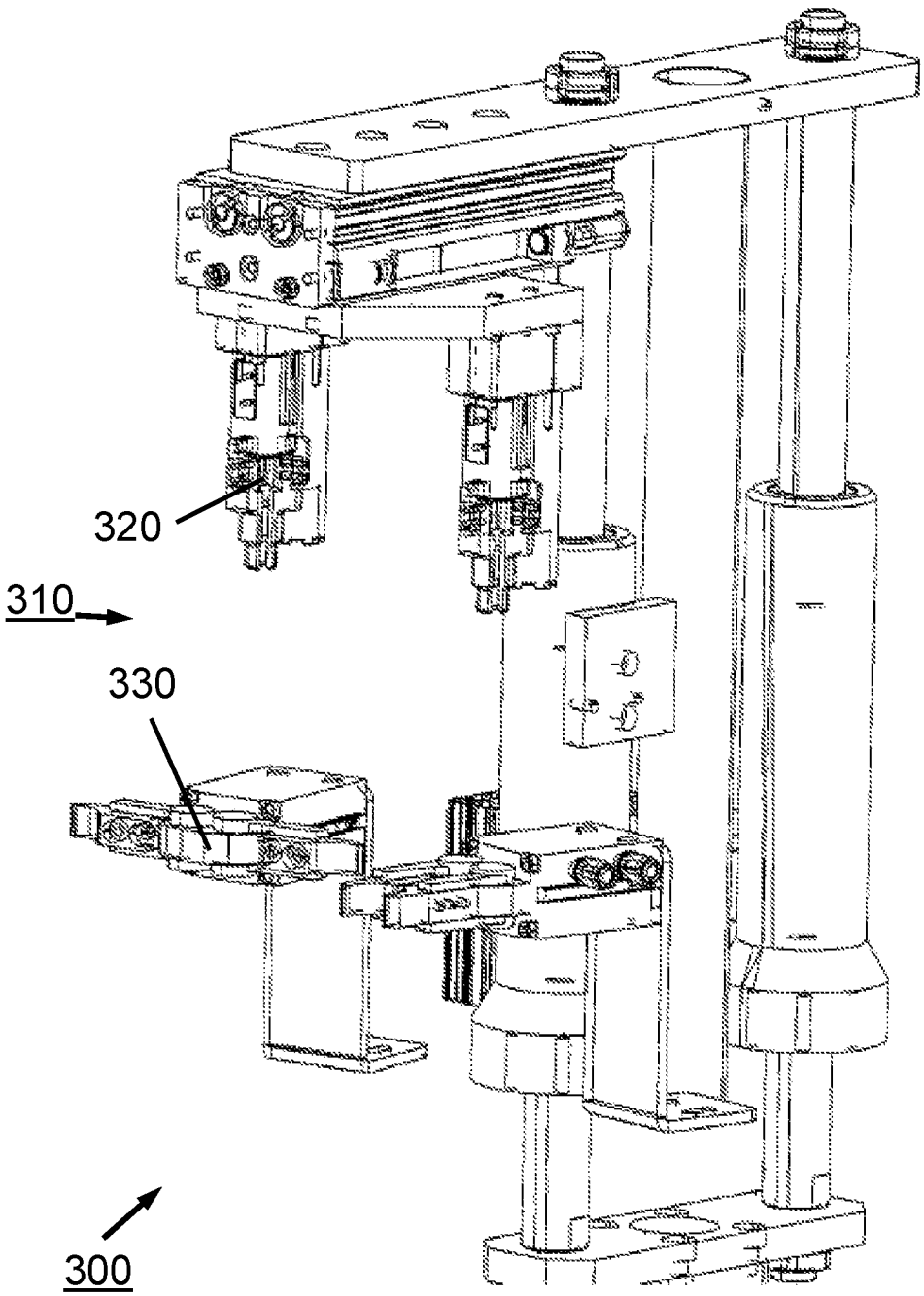
FIG. 3: is a schematically perspective view to the mounting station of the assembling apparatus according to FIG. 1.

FIG. 3 is a schematically perspective view to mounting station 300 of assembling apparatus 1 according to FIG. 1. Mounting station 300 includes two identical mounting means 310, each of which has a delivering device 320 for delivering a dispensing device 620 to the working area of the mounting means, and a gripper 330 for gripping dispensing device 620 provided by delivering device 320 and attaching said dispensing device 620 to the first end 612 of tubular casing 610 provided by a cartridge 20 (not shown). Delivering device 320 and gripper 330 comprise respective drives (not shown) for being moved when delivering and mounting dispensing device 620 to tubular casing 610. Delivering device 320 is horizontally arranged above gripper 330 and horizontally movable in order to position dispensing device 620 vertically above gripper 330. Gripper 330 according to FIG. 3 is vertically movable and includes two claws for gripping dispensing device 620 provided by delivering device 330, when in an upper position, and for attaching said dispensing device 620 to the first end 612 of tubular casing 610 when moved downwardly.

Figure 4:
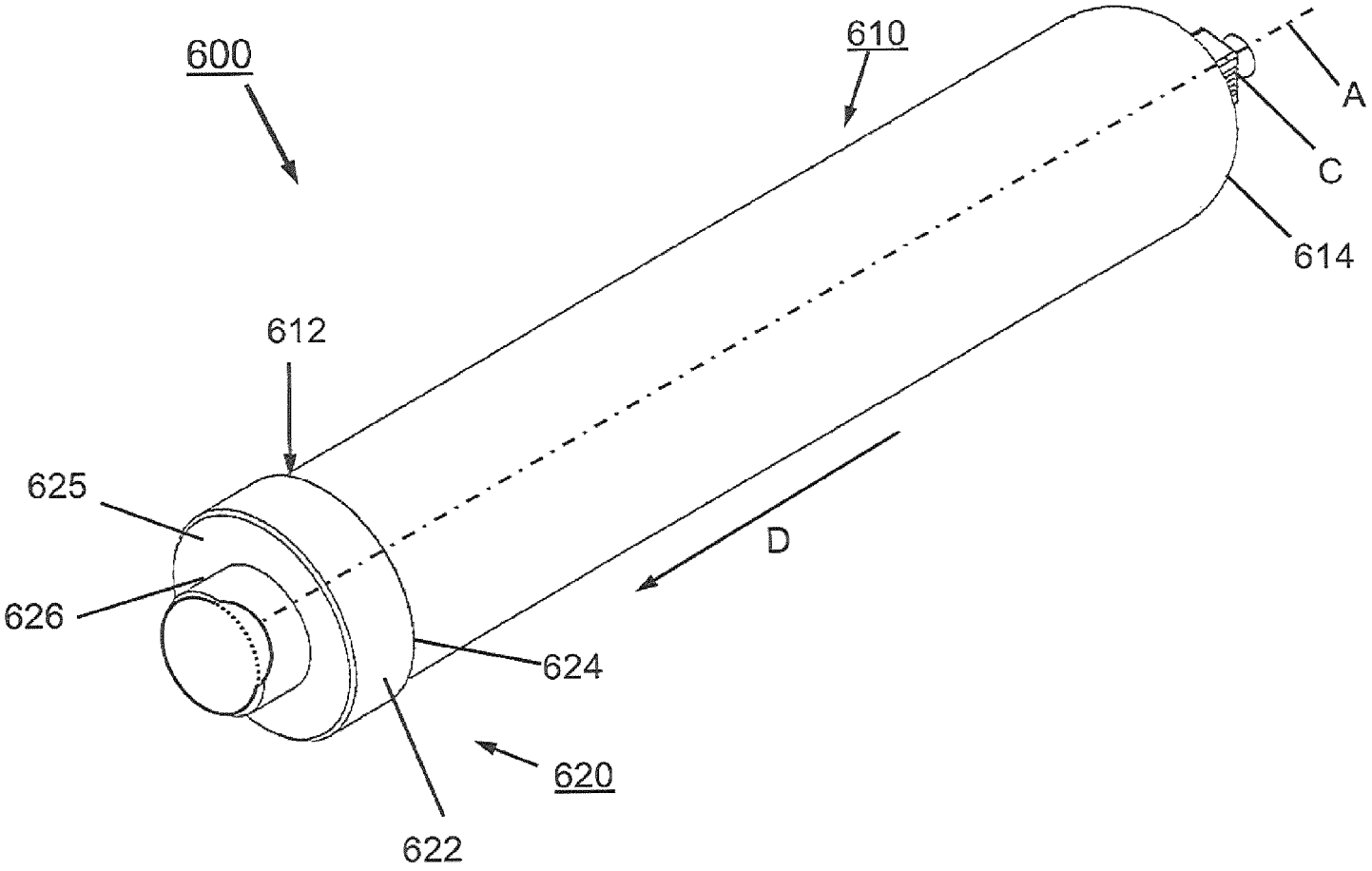
FIG. 4: is a perspective view to a first embodiment of the packaging combination according to the present invention.

FIG. 4 shows a perspective view to a first embodiment of the packaging combination 600 according to the present invention. The packaging combination 600 includes a sausage-shaped tubular casing 610 having a first end 612 and a second end 614, wherein second end 614 is closed by closure clips C, and a dispensing device 620 attached to the first end of 612 of tubular casing 610. Tubular casing 610 has a central axis A extending through first end 612 and second end 614. Dispensing device 620 has a first portion 622 including an inlet opening 624 and a second portion 626 including an outlet or dispensing opening 628, thereby defining a dispensing direction D. As it further can be seen in FIG. 4, dispensing opening 628 is closed by a sealing device 630. Sealing device 630 is formed by a flat material, like a plastic or metal foil, and has an approximately circular sealing portion 632 and an opening portion or strap 634. The diameter of sealing portion 632 corresponds at least approximately to the outer diameter of second portion 626 of dispensing device 620, and completely covers dispensing opening 628. Opening portion or strap 634 is of an approximately semicircular shape and of a dimension, which allows pulling off sealing device 630 from dispensing device 620 only by hand without any additional opening tools. Sealing element 630 may be fixed to dispensing device 620 e.g. by a sealing process including a heat-sealing or a gluing process using a respective adhesive, like a hot-melt or cold acting glue for fixing sealing element 630.

In the embodiment of packaging combination 600 according to FIG. 4, tubular casing 610 is of a circular cross-section. Accordingly, also dispensing device 620 is of a generally circular cross-section at least for the first portion 622. First portion 622 of dispensing device 620 has an inner and outer cylindrical shape having an inner diameter which corresponds to the outer diameter of tubular casing 610. Second portion 26 which also has an inner and outer cylindrical shape, is directly coupled to first portion 622 in the dispensing direction D via an annular offset 625. First portion 622, annular offset 625 and second portion 626 are coaxially arranged to central axis A of tubular casing 610. Moreover, the axial length of dispensing device 620 is clearly shorter than the axial length of the tubular casing 610. Thereby, dispensing device 620 is preferably made of plastics.

Figure 5:
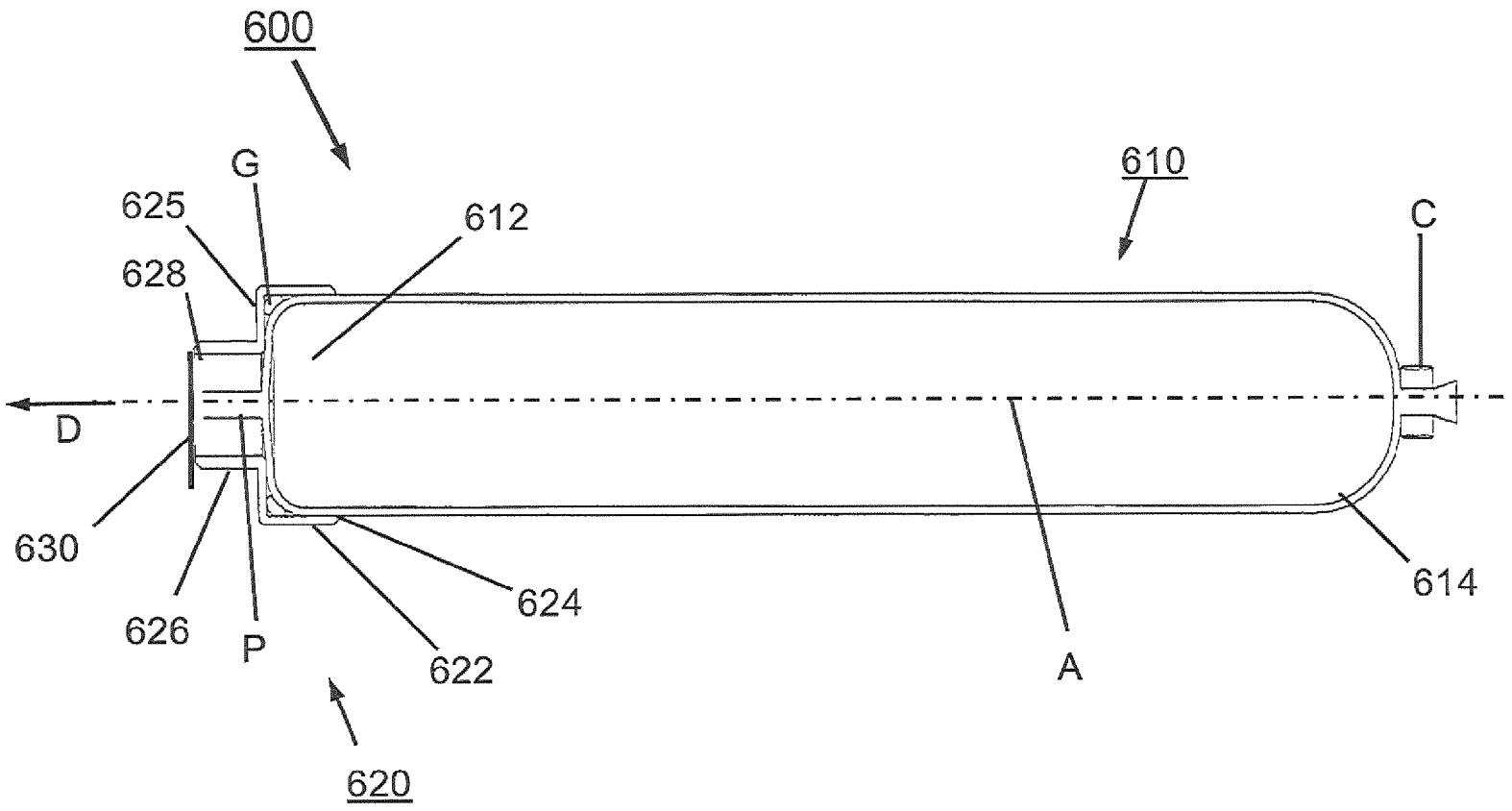
FIG. 5: is a longitudinal-section to the embodiment of the packaging combination of FIG. 4.

FIG. 5 shows a longitudinal-section along central axis A of the embodiment of the packaging combination 600 of FIG. 4. As it can be seen in FIG. 5, the outer diameter of tubular casing 610 corresponds to the inner diameter of the first portion 622 of dispensing device 620. Annular offset 625 and first portion 622 are approximately rectangular aligned to each other, thereby forming a flange surrounding the outer edge of first end 612 of tubular casing 610. Between inlet opening 624 and dispensing opening 628, there extends a passageway formed by the inner walls of the first and second portion 622, 626 of the dispensing device 620.

For fixedly attaching dispensing device 620 to tubular casing 610, an adhesive G, preferably a hot-melt adhesive or a glue, is disposed at the inside of the flange formed by annular offset 625 and first portion 622. The amount of adhesive G is sufficient for at least approximately filling the gap between first end 612 of tubular casing 610, annular offset 625 and first portion 622 of dispensing device 620.

As it further can be seen in FIG. 5, plait-like portion P at the first end 612 of tubular casing 610, which is at least approximately free from filling material and which has been formed in a known manner during filling and closing tubular casing 610, has a length that corresponds to the axial length of the second portion 626 of dispensing device 620. The length of plait-like potion P is at least equal to the axial length of the second portion 626 of dispensing device 620. Second end 612 and thus, plait-like portion P, is not closed by a closure clip C. Said closure clip C, which has been closed first end 612 during the production of the partially filled tubular casing 610, has been removed after dispensing device 620 has been mounted thereto and immediately before sealing device 630 has been attached to dispensing opening 628 of dispensing device 620.

It has to be understood that, for attaching dispensing device 620 to first end 612 of tubular casing 610, the inner diameter of the second portion 626 of dispensing device 620, forming the dispensing opening 628, has to be at least slightly larger than the outer diameter of the closed closure clip C attached to first end 612. Accordingly, plait-like portion P closed by a closure clip C, has a length sufficient to extend through dispensing device 620 via inlet opening 624 and dispensing opening 628 to enable closure clip C closing first end 612, project from dispensing opening 628 in the dispensing direction D in order to remove closure clip C from first end 612 and for subsequently attaching sealing device 630 to dispensing opening 628.

A second embodiment of packaging combination 600 is shown in FIG. 6. This packaging combination 600 includes the tubular casing 610 having a first end 612, a second end 614 as well as a plait-like portion P and the dispensing device 620 having a first portion 622 including an inlet opening 624 and a second portion 626 including an outlet opening 628, both known from the embodiment according to FIGS. 4 and 5.

Additionally, the packaging combination 600 includes a closure cap 40 for closing dispensing opening 28 of dispensing device 20 and a dispensing nozzle 50 for being attached to the dispensing opening 28, in order to dispense a desired amount of filling material.

Closure cap 640 includes a cylindrical portion 642 having a first end 642*a* and a second end 642*b* and a conical portion 644 being attached to second end 642*b* of cylindrical portion 642. As it can be seen in FIG. 7, which is a longitudinal-section to the embodiment of the packaging combination 600 of FIG. 6, the inner diameter of cylindrical portion 642 corresponds to the outer diameter of second portion 626 of dispensing device 620. The axial length of cylindrical portion 642 is at least approximately equal to the axial length of second portion 626 of dispensing device 620. As it can be seen in FIG. 7, cylindrical portion 642 is slightly longer than portion 626 of dispensing device 20.

In order to reversibly attach and release closure cap 640 to or from dispensing device 620, in particular to or from second portion 626 of dispensing device 620, an inner screw thread is provided at the inner surface of cylindrical portion 642 of closure cap 640, which matches with an outer screw thread provided at the outer surface of second portion 626 of dispensing device 620.

Figure 7:
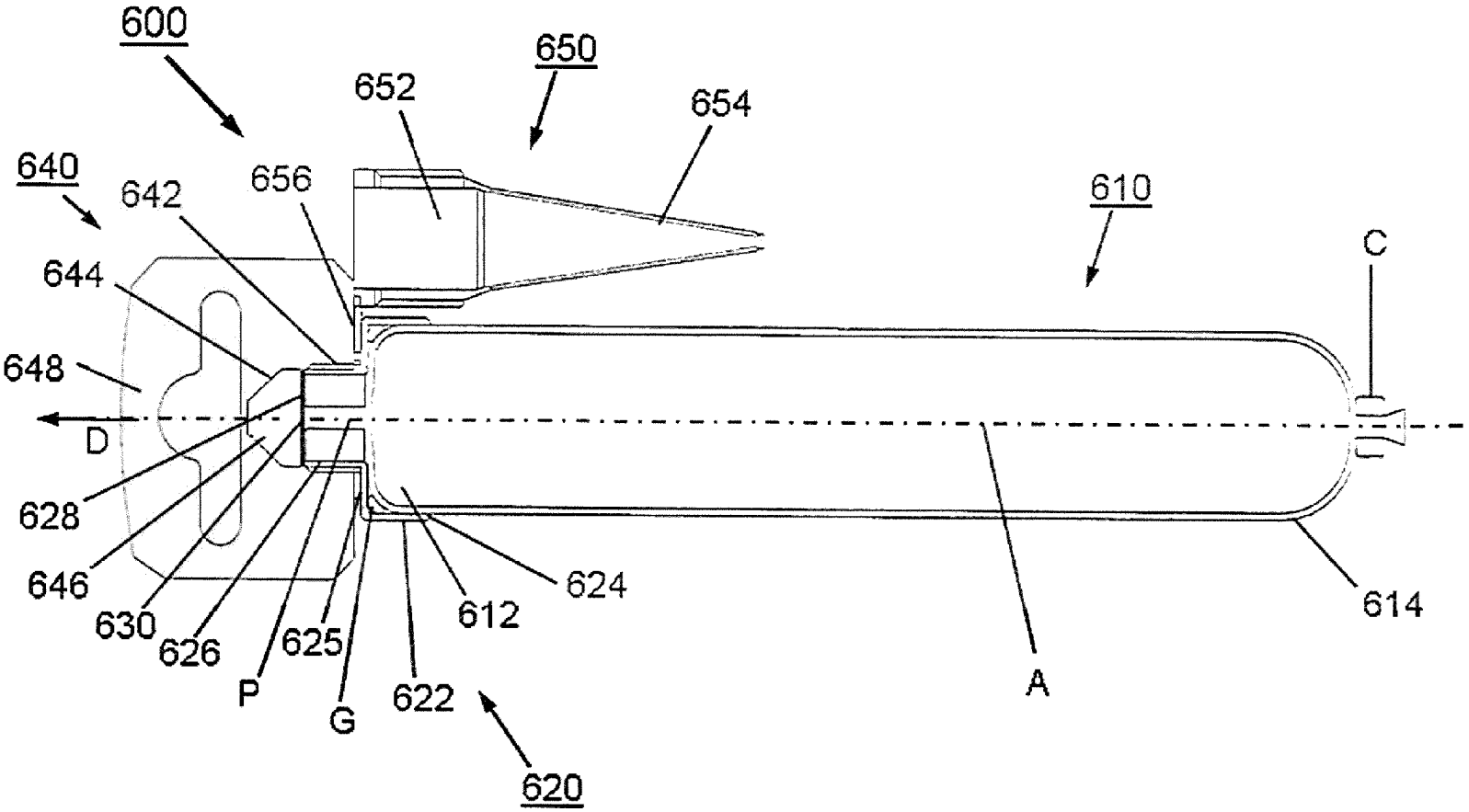
FIG. 7: is a longitudinal-section to the embodiment of the packaging combination of FIG. 6.

Closure cap 640 according to FIGS. 6 and 7 further comprises a flat fin member 648 arranged in a plane extending through longitudinal axis A of tubular casing 610, when being attached to dispensing device 620. Flat fin member 648 is coupled to the outside of cylindrical portion 642 and conical portion 644, and includes an opening arranged above conical portion 644 in the dispensing direction D. Fin member 648 thereby forms a hanger. For an easier opening of closure cap 640, the outer surface of cylindrical portion 642 is provided with grooves extending parallel to axis A.

As it further can be seen in FIG. 7, dispensing opening is sealed by sealing device 630. Circular sealing portion 632 thereby entirely covers dispensing opening 628. Opening portion or strap 634, which is not visible in FIG. 7, has been folded to the outside of second portion 626 during attaching closure cap 640 to dispensing device 620.

As mentioned above, packaging combination 1 of FIGS. 6 and 7 further includes dispensing nozzle 650. Dispensing nozzle 650 has a hollow cylindrical portion 652 and a hollow conical portion 654 coupled to cylindrical portion 652. At the inner surface of cylindrical portion 652, an inner screw thread is provided matching with outer screw thread of second portion 626 of dispensing device 620 for reversibly attaching dispensing nozzle 650 thereto. Hollow conical portion 654 is open at its one end, which is coupled to conical portion 654 and closed at its other end forming a tip. In order to allow filling material to be dispensed through dispensing nozzle 650, the tip has to be cut off. The size or diameter of the dispensing opening of nozzle 650 depends on the position of the cutoff at conical portion 654 of dispensing nozzle 650. Nozzle 650 further comprises a flap element 56 extending radially from cylindrical portion 652 and including a circular opening for securing dispensing nozzle 650 to second portion 626 of dispensing device 650.

The packaging combination 600 according to the present invention further comprises an indicating unit (not shown) for indicating the originality of the closure of the dispensing opening. Said indicating unit may have the form of a small sheet attached to the dispensing device 620, e.g. at the outside of annular offset 625 for being coupled with closure cap 640 when being closed for the first time. When opening originally closed packaging combination 600, the indicating unit is re-moved from closure cap 640 and/or from annular offset 625 of dispensing device 620, indicating that packaging combination 600 is not originally closed anymore, and further indicating, in case of the presence of a cutting element inside closure cap 640, that tubular casing 610 is opened and that filling material may escape from packaging combination 600 when releasing closure cap 640. The indicating unit may also be originally attached to the closure cap 640 and may then be coupled to dispensing device 620 when being closed for the first time. Naturally, an indicating unit may also be attached to any other suitable part of the packaging combination, where it's possible to indicate the originality of the closure of the dispensing device or at least of the dispensing opening. Naturally, also sealing device 630 provides an indicating unit for indicating the originality of the closure of the dispensing opening when present at dispensing opening 628.

Adhesive G provided at the inside of the flange formed by annular offset 625 and first portion 622 in order to secure dispensing device 620 to the first end 612 of tubular casing 610 has been described as being a hot-melt adhesive. Dependent on the material of tubular casing, which may be a suitable plastic foil or a natural material, the material of dispensing device 620, which is preferably made of plastic but also from any other suitable material, like a metal, the adhesive G may also be an other than a hot-melt adhesive. E.g. in case of temperature sensitive filling materials or casing material, a cold acting adhesive is required.

For assembling a packaging combination 600 including a tubular casing 610 and a dispensing device 620, a tubular casing 610 is received by horizontally aligned band conveyor 110 of receiving station 100. In receiving station 100, tubular casing 30 arranged horizontally on band conveyer 110 is transferred in a vertical position above cartridge 20 and placed in cartridge 20 with its first end 612 including plait-like portion P directed upwardly.

After positioning tubular casing 610 in cartridge 20, circular table 10 is rotated counter-clockwise about a predefined angle. Thereby, tubular casing 610 together with cartridge 20 is positioned in shaping station 200 below shaping means 210. In this position, shaping means 210, in particular claws 230 are in an opened position. Drive assembly D is actuated and moves cartridge 20 and tubular casing 30 upwardly in a position, in which first end 612 of tubular casing 610 is in the working area of shaping means 210. Thereafter, claws 230 will be closed for gripping first end 612 of tubular casing 610, in particular, closure clip C. Shaping ring 220 consisting of segments 220*a*, 220*b*, is positioned around and closely surrounds plat-like portion P. Shaping ring 220 is then moved down along plait-like portion P and away from claws 230, thereby creating a shape to the first end 612 of tubular casing 610, corresponding to the inner shape of shaping ring 220. Thereafter, shaping ring 220 is moved back towards claws 230 and away from plait-like portion P. Claws 230 are opened for releasing first end 612 of tubular casing 610, and cartridge 20 together with tubular casing 610 is shifted downwardly by drive assembly D.

Next, table 10 is rotated counter-clockwise for positioning cartridge 20 with tubular casing 610 having a defined shaped first end 612 in mounting station 300 below mounting means 310. In mounting station 300, a dispensing device 620 is provided by delivering device 320. Below delivering device 320, vertically movable gripper 330 is provided. In its upper position, gripper 330 grasps dispensing device 620 held by delivering device 320, and moves vertically downwardly to-wards first end 612 of tubular casing 610 provided by cartridge 20. Gripper 330 mounts dispensing device 620 to the first end 612 of tubular casing 610 by means of an adhesive G disposed at an inner surface of dispensing device 620 which comes into contact with the outer surface of tubular casing 610. Plait-like portion P thereby is guided through and extends beyond the dispensing opening 628 of dispensing device 620.

After moving gripper 330 in its opened position, table 10 further turns counter-clockwise for positioning cartridge 20 with tubular casing 610 and dispensing device 620 attached thereto, in the sealing station. In said sealing station, closure clip C at first end 612 of tubular casing 610 is gripped by gripping means, which may similarly constructed like gripper 330 and removed from plait-like portion P by respective removing means, like one or more cutting elements. Subsequently, a seal 630 is attached to dispensing opening 628 of dispensing device 620. Said sealing operation may be a heat sealing. Alternatively, sealing device 630 may also be mounted to dispensing device by a respective adhesive, like a hot-melt adhesive.

After the sealing operation, table 10 further turns counter-clockwise for positioning cartridge 20 with tubular casing 610 and dispensing device 620 in attachment station 400 vertically below the attachment means for attaching a closure cap 640 and/or a dispensing nozzle 650 to dispensing device 620. The attachment means include gripping and rotating means for gripping and screwing a closure cap 640 to dispensing device 620. Said attachment means are commonly known and thus, need not to be described in detail.

At discharge station 500, to which cartridge 20 together with the packing combination 600 is moved by further rotating table 10, packing combination 600 is re-moved from cartridge 20 by lifter arrangement 512 and deposited on conveyor arrangement 514 for being distributed from assembling apparatus 1.

In conjunction with FIG. 2, drive assembly D has been described for moving upwardly cartridge 20 for positioning first end 32 of tubular casing 30 in the working area of shaping station 200. Naturally, also the shaping 210 may be vertically movable, whereby an additional movement of cartridge 20, and drive assembly D respectively, is not necessary. It has also to be understood, that, even if not described, each working station may comprise a drive assembly D for moving cartridge 20 vertically into the working area of the respective work station.

Shaping ring 220 according to FIG. 2 consists of two segments 220*a*, 220*b* and has been described as being moved towards plait-like portion P after first end 32 has been grasped by claws 230. In an alternative embodiment, the shaping ring 220 may be formed as a single part. Accordingly, said shaping ring 220 has to be placed around plait-like portion P before the first end 32 of tubular casing 30 has been grasped by claws 230.

Moreover, attachment station 400 needs not necessarily be part of the assembling apparatus, in particular, in case that no closure cap has to be attached to the packaging combination.

As it can be seen in FIG. 1, at table 10, additional space has been left for positioning additional work stations there, e.g. for attaching other parts to the packaging combination, like labels or the like.

Circular table 10 shown in FIG. 1, for moving tubular casing 30 between the work stations has to be understood as one possible embodiment of a moving device. Other moving means may be used for transporting the tubular casing between the work stations, like robotic devices or any other suitable conveying means.

The present assembling apparatus includes receiving means in the form of a band conveyor as one possible embodiment of a conveyor device. For receiving a tubular casing being at least partially filled and comprising a plait-like portion, the assembling apparatus may be directly connected to a clipping machine by said conveying means. Otherwise, a respective storage device including a number of tubular casings, may be coupled to said conveying means.

The invention claimed is:

1. An apparatus for assembling a packaging combination including a tubular casing having a first end and a second end, wherein the tubular casing is partially filled with filling material and closed at its first as well as its second end by a closure clip, and wherein the partially filled tubular casing comprises a plait-like portion at its first end being at least approximately free of filling material, and further including a dispensing device having a passageway extending through the dispensing device with an inlet opening at its one end and a dispensing opening at its other end for guiding and dispensing the filling material in a dispensing direction, wherein the apparatus comprises:

at least one supporting means for accommodating and retaining the at least partially filled tubular casing, including at least one cartridge for arranging the at least partially filled tubular casing;

at least one gripper means for gripping the first end of the at least partially filled tubular casing;

at least one forming shoulder that is distinct from the at least one gripper means and that is for forming a defined shape to the said first end; and at least one mounting means for mounting the dispensing device to said first end of the tubular casing.

2. The apparatus according to claim 1, wherein the cartridge is coupled with a drive means for moving said cartridge.

3. The apparatus according to claim 2, wherein the drive means include a piston/cylinder assembly.

4. The apparatus according to claim 1, wherein the forming shoulder of the shaping means is a shaping ring having an inner surface corresponding to the shape to be created of the first end of the tubular casing.

5. The apparatus according to claim 4, wherein the shaping ring consists of ring segments.

6. The apparatus according to claim 1, wherein the gripper means of the shaping means include at least one claw for gripping the first end of the tubular casing.

7. The apparatus according to claim 1, further including a drive means for reversible moving the forming shoulder and the gripper means relative to each other.

8. The apparatus according to claim 1, further comprising receiving means for receiving the partially filled tubular casing.

9. The apparatus according to claim 1, further comprising receiving means for receiving the dispensing device.

10. The apparatus according to claim 1, further comprising attachment means for attaching a closure cap and/or a dispensing nozzle to the dispensing device.

11. The apparatus according to claim 1, wherein at least the supporting means, the shaping means and the mounting means are arranged in work stations.

12. The apparatus according to claim 1, further comprising an attachment means for attaching a seal to the dispensing opening of the dispensing device.

13. A method for assembling a packaging combination in an assembling apparatus including a tubular casing having a first end and a second end, wherein the tubular casing is partially filled with filling material and closed at its first as well as its second end by a closure clip, and wherein the partially filled tubular casing comprises a plait-like portion at its first end being at least approximately free of filling material, and further including a dispensing device having a passage way extending through the dispensing device with an inlet opening at its one end and a dispensing opening at its other end for guiding and dispensing the filling material in a dispensing direction, and wherein the assembling apparatus comprises a supporting unit, at least one shaping unit and at least one mounting unit, the method comprises the steps of:

accommodating and retaining the at least partially filled tubular casing in the supporting unit;

positioning a forming shoulder at the first end of the tubular casing in the at least one shaping unit;

gripping the first end of the tubular casing with gripping means that is distinct from the forming shoulder;

forming a defined shape to the first end of said tubular casing by moving the gripping means as the gripping means grips the first end of the tubular casing and the forming shoulder relative to each other; and mounting a dispensing device to said first end of said tubular casing in the at least one mounting unit.

14. The method according to claim 13, further comprising the step of receiving the at least partially filled tubular casing.

15. The method according to claim 13, further comprising the step of moving the at least partially filled tubular casing between working stations including at least the supporting unit, the shaping unit and the mounting unit.

16. The method according to claim 13, further comprising the step of attaching a closure cap and a dispensing nozzle to the dispensing device.

17. The method according to claim 13, further comprising the step of attaching a seal to the dispensing opening of the dispensing device.

* * * * *